US009545136B2

(12) United States Patent
Cochrane

(10) Patent No.: US 9,545,136 B2
(45) Date of Patent: Jan. 17, 2017

(54) FABRIC WRAP JEWELRY ITEM AND CUSTOMIZABLE DECORATIVE TAGS

(71) Applicant: Amy Lori Cochrane, Woodbury, MN (US)

(72) Inventor: Amy Lori Cochrane, Woodbury, MN (US)

( * ) Notice: Subject to any disclaimer, the term of this patent is extended or adjusted under 35 U.S.C. 154(b) by 150 days.

(21) Appl. No.: 14/296,202

(22) Filed: Jun. 4, 2014

(65) Prior Publication Data

US 2014/0360228 A1 Dec. 11, 2014

Related U.S. Application Data

(60) Provisional application No. 61/831,174, filed on Jun. 5, 2013.

(51) Int. Cl.

| | |
|---|---|
| ***A44C 5/00*** | (2006.01) |
| ***A44C 15/00*** | (2006.01) |
| ***A43B 3/00*** | (2006.01) |
| ***A43C 11/24*** | (2006.01) |

(52) U.S. Cl.

CPC ..... *A44C 5/0015* (2013.01); *A43B 3/0078* (2013.01); *A43C 11/24* (2013.01); *A44C 5/0069* (2013.01); *A44C 15/004* (2013.01)

(58) Field of Classification Search

CPC ..... A44C 5/0015; A44C 11/24; A44C 5/0069; A44C 15/004; A44C 5/00; A44C 5/0053; A43B 3/0078

USPC ..... 63/37, 11; 2/279, DIG. 11; D11/6, 11

See application file for complete search history.

(56) References Cited

U.S. PATENT DOCUMENTS

| | | | | |
|---|---|---|---|---|
| 7,658,020 | B1 * | 2/2010 | Yun | A43B 3/0078 36/136 |
| 2009/0297793 | A1 * | 12/2009 | Yun | C09D 175/04 428/195.1 |

* cited by examiner

*Primary Examiner* — Jack W Lavinder

(74) *Attorney, Agent, or Firm* — Brooks, Cameron & Huebsch, PLLC

(57) ABSTRACT

A fabric wrap jewelry item embodiment includes an elongate strip of fabric having a width, an elongate length, and two ends, wherein the elongate length is sized to wrap at least twice around an appendage of a wearer and the ends connected together to form a loop of fabric material, and a pendant affixed to the elongate strip of fabric.

19 Claims, 12 Drawing Sheets

504

FABRIC WRAP JEWELRY ITEM AND CUSTOMIZABLE DECORATIVE TAGS

CROSS-REFERENCE TO RELATED APPLICATIONS

This application claims the benefit of U.S. Provisional Patent Application No. 61/831,174, filed Jun. 5, 2013, which is herein incorporated by reference.

BACKGROUND

Bracelets are popular items to wear, but are troublesome for active individuals or people engaging in exercise because they tend to slip, rub, or otherwise irritate the wrist.

Conventional bracelet designs have several deficiencies including clasp, sizing, safety, durability, appearance, and comfort issues. For example:

Clasp issues: Clasps are notoriously difficult to operate by oneself and are by nature typically the weak point of any bracelet design. Such difficulties in operation are particularly true for children and for the elderly. Additionally, clasps can open, allowing the bracelet to become lost. Clasps can also break over time from repeated opening and closing, thereby rendering the bracelet useless.

Sizing issues: Bracelets are typically made with an average 7.25" wrist in mind. However, many individuals with larger or smaller wrists have difficulty finding bracelets that fit them.

Safety issues: Bracelets that are rigid or hang loosely off the wrist can more easily catch or snag on clothing or other objects. This is a potential safety hazard, especially when the wearer is engaging in more vigorous activities.

Durability: Bracelets often employ the use of jumprings in their design. A jumpring is often used to attach the clasp to the actual bracelet. This creates a weak point in the bracelet design, and in many instances, any tugging on the bracelet can cause the jumpring to open.

Appearance: Bracelets often have a focal bead or main pendant in their design. The weight of the focal bead or main pendant causes it to slip around to the underside of the wrist so that it becomes hidden or the bracelet appears to be the wrong side up.

Comfort: Bracelets can be bothersome to wear because they are heavy, bulky, scratchy, or fit loosely around the wrist. Movement through exercise or increased activity exacerbates all of these comfort issues. Comfort issues are even more important for wearers who, often for medical reasons, need to wear a bracelet throughout the entire day (such as a medical alert bracelet).

Some of the issues listed above are more tolerable for "everyday" jewelry wearers, but make the wearing of such jewelry difficult for active and exercise-minded individuals. Rubber band-type bracelets have been designed to overcome some of these issues. However, they still fit loosely on the wrist, causing rubbing to occur. They also are not made of a breathable, washable material and thus are more irritating to the skin during perspiration. The issues noted above are even more problematic for people with certain serious medical conditions, such as Diabetes, Epilepsy, and severe allergies. These individuals are advised to continuously wear a medical alert bracelet, which are most often a metal chain design, which can have many of the issues discussed above.

Additionally, tags for placement on shoes have be utilized, however these tags utilize tags that have charms affixed to their surface or are created from plastic materials which involve the use of molds to form the design. Although nice looking, changing the design of these tags is expensive due to the creation of new charms or new molds.

DETAILED DESCRIPTION

Figure 1:
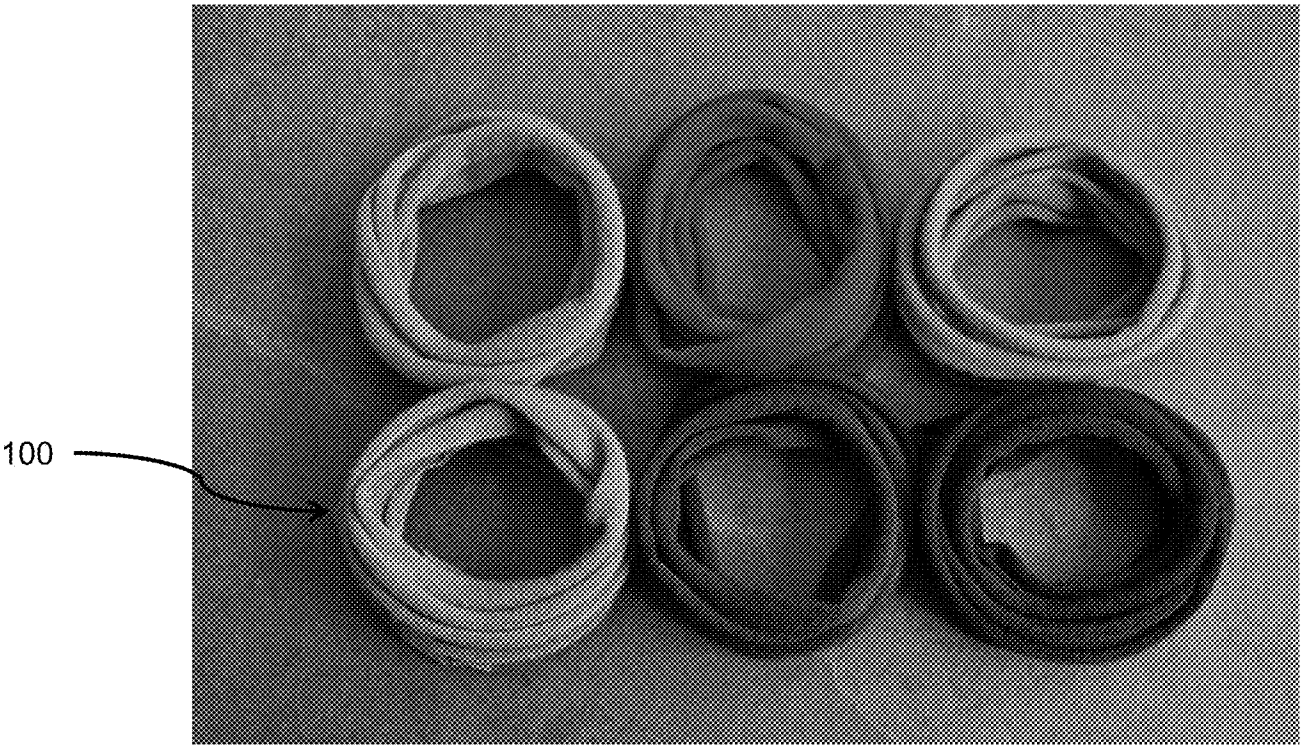
FIG. 1 illustrates examples of a number of fabric wraps for use with one or more embodiments of the present disclosure.

The present disclosure includes various jewelry item and method embodiments, as well as various customizable metal tag embodiments that lace onto footwear. The fabric wrap jewelry item design embodiments of the present disclosure successfully overcome all of the above obstacles that active individuals encounter when considering jewelry item use, such as with bracelets as discussed above. For example:

Clasp: The fabric wrap jewelry item design embodiments of the present disclosure, when worn as a bracelet, have overcome the need for a clasp, as the elastic qualities of the fabric wrap jewelry item embodiments allow the jewelry item to be easily slipped off and wrapped back on. There are no difficult to maneuver clasps or hooking mechanisms. The elongate strip of fabric used to form the fabric wrap jewelry item can be sized such that the ends can be tied together to form the loop of fabric material. In such an embodiment, the material can be secured with a knot to size the jewelry item and a series of twisting wraps around the wrist of a wearer, with the knot capable of being untied or cut off, if desired. The ends can also be connected in other ways, for example, by adhesive, or by mechanical means, such as by stitching, etc.

Size: The fabric wrap jewelry item is a truly one-size-fits-all design, as it can wrap around fewer or more times depending on the wearer's wrist size. If desired, it can also be cut down in length so that it does not wrap around as many times.

Multi-Functionality: In some embodiments, the fabric wrap jewelry item can be worn as a bracelet, necklace, or anklet depending on the desire of the wearer and the length of the fabric material.

Safety: The fabric wrap jewelry item is close-fitting, reducing the risk of catching or snagging and thereby increasing the safety of this design.

Durability: Due to the stretchiness of the fabric material, the jewelry item can withstand repeated tugging, because the material gives when tugged upon and then returns substantially or fully to its original size. The material can also withstand repeated use (e.g., twisting and stretching while wrapping the jewelry item on and taking it off) while still maintaining its stretching properties.

In some embodiments, jumprings can be used to attach a pendant to the fabric wrap jewelry item. For example, a fabric wrap jewelry item can include at least one jumpring that affixes the pendant to the elongate strip of fabric. In embodiments with stretchy material, the "spring" (i.e., stretchiness) in the material also means that if the pendant is tugged on, very little tension is applied to the jumprings holding a pendant to the fabric material. Therefore, the jumprings stay secure and do not open.

Appearance: As the fabric wrap jewelry item (e.g., when worn as a bracelet) fits snugly to the wrist and does not move around, the metal pendant stays put and the jewelry item stays "right-side-up". For some wearers, the jewelry item can be used as a necklace, where the wearer wraps the jewelry item around their neck in a similar manner of twisting wraps used around the wearer's wrist.

Comfort: The fabric wrap jewelry item (e.g., when worn as a bracelet) fits close to the wrist, but doesn't apply any squeezing pressure. As discussed above, the fabric wrap jewelry item stays in place and also doesn't rub, slip, chafe, or otherwise irritate the wearer. The fabric is also breathable and washable, which can be important traits for active individuals.

One or more of the above advantages can be accomplished through use of an embodiment of the present disclosure. For example, one embodiment includes a fabric wrap jewelry item, comprising an elongate strip of fabric having a width, an elongate length, and two ends, wherein the elongate length is sized to wrap at least twice around an appendage of a wearer and the ends connected together to form a loop of fabric material, and a pendant affixed to the elongate strip of fabric.

In another embodiment, a fabric wrap jewelry item includes, an elongate strip of fabric having elastic qualities that allows the elongate strip of fabric to be stretched to a stretched length that is longer than an un-stretched length and having a width, an elongate length, and two ends, wherein the elongate length is sized to wrap at least twice around an appendage of a wearer and the ends connected together to form a loop of fabric material, and a pendant affixed to the elongate strip of fabric.

In some embodiments, a fabric wrap jewelry item can include an elongate strip of fabric having elastic qualities that allows the elongate strip of fabric to be stretched to a stretched length that is longer than an un-stretched length and having a width, an elongate length, and two ends, wherein the elongate length is sized to wrap at least twice around an appendage of a wearer and the ends connected together to form a loop of fabric material, and a pendant affixed to the elongate strip of fabric with at least one jumpring wherein the elongate strip of fabric passes through an aperture formed by the jumpring and wherein the pendant is made from a metallic material having a hardness that allows for the pendant to be customized by indentation of one or more stamps (e.g., by indentation using a machine or by hand hammering as discussed below). In some embodiments, the pendant is made from a metallic material having a hardness that allows for the pendant to be customized by indentation of one or more stamps that are hammered by a user (e.g., the wearer or a person manufacturing the pendant) against the pendent to make the indentation. These and other embodiments are disclosed in more detail herein.

Reference is made herein to the accompanying drawings, and in which is shown by way of illustration how one or more embodiments of the disclosure may be practiced. These embodiments are described in sufficient detail to enable those of ordinary skill in the art to practice the embodiments of this disclosure, and it is to be understood that other embodiments may be utilized and that process and/or structural changes may be made without departing from the scope of the present disclosure.

As will be appreciated, elements shown in the various embodiments herein can be added, exchanged, and/or eliminated so as to provide a number of additional embodiments of the present disclosure. In addition, as will be appreciated, the proportion and the relative scale of the elements provided in the figures are intended to illustrate certain embodiments of the present invention, and should not be taken in a limiting sense.

FIG. 1 illustrates examples of a number of fabric wraps for use with one or more embodiments of the present disclosure. The embodiments shown in FIG. 1 provide examples of strips of fabric 100 that are designed to wrap around a wearer's appendage (e.g., arm, leg, neck, etc.) multiple times to form the wrapped design. In some embodiments, the strip of material forming the body of the item can be sized such that it can be worn on multiple appendages depending on the number of wraps are made (e.g., the same fabric wrap jewelry item can be worn as a necklace, bracelet, and anklet).

Having tested a wide variety of materials, it was found that many of the materials were deficient or suboptimal in one or more of the goals and/or qualities of the design. For example, some materials do not retain their "spring" from repeated use, from tugging, and/or from washing the jewelry item. This elasticity can be vital to the fabric wrap jewelry item design, in some embodiments.

The "spring" can be described as the elongate strip of fabric having at least a portion thereof made from a material that has elastic qualities that allows the elongate strip of fabric to be stretched to a stretched length that is longer than an un-stretched length. Such an embodiment would let the jewelry item stretch in some portions and not in others or, where the entire strip of fabric is made from the same stretchy material, all of the strip can be stretched and any portion can be stretch (e.g., when the wearer wants to stretch just a portion to rearrange that portion of the fabric).

Further, some materials would fray at the edges after being cut into strips and therefore were not suitable with regard to one or more of the characteristics including, but not limited to: appearance, durability, safety, and comfort. Some materials did not curl in at the edges. This feature of the fabric allows for the fabric to be unique in appearance, allows the edges to be somewhat protected from any rough treatment during use, and provides a more comfortable feel for the wearer, among other benefits.

However, there were materials identified that met the necessary qualities and goals of the embodiments of the present disclosure, the best of which was a fabric blend comprised of 95% Rayon and 5% Spandex. This provided excellent wear-ability and comfort, as rayon has many qualities of natural fibers, is highly absorbent, and is a poor insulator (i.e., does not retain body heat, therefore keeping cool when used in hot and humid physical activities). This fabric provided very good elastic qualities as will be discussed in more detail herein.

The addition of Spandex to the blend provides a suitable amount of elasticity, but not allowing the material to be too stretchy for a comfortable conforming fit to the wearer's wrist, which helps to meet the qualities and goals as described above, including, but not limited to eliminating a clasp, ability to easily adjust sizing and fit, improved safety, improved durability, and improved comfort. The specific fabric is only detailed here for illustrative purposes, and it should be understood that other suitable fabrics, that meet the qualities and goals of the embodiments of the present disclosure can be utilized.

One of the benefits of these fabric choices is that they enable an additional design feature which allows for color customizability. For example, in some embodiments, the fabric wrap jewelry item can include a strip of fabric that is fabricated from a material that allows dye to be applied at an event in which a wearer of the jewelry item participates and the dye changes the color of at least a portion of the strip.

Rayon, in particular, has excellent dye uptake and retention, making it a suitable choice for anyone wishing to change the color of their jewelry item (through either manual or experiential means, such as participation in a "Color" event where race participants are splattered with colored dyes in a non-toxic medium).

Figure 2:
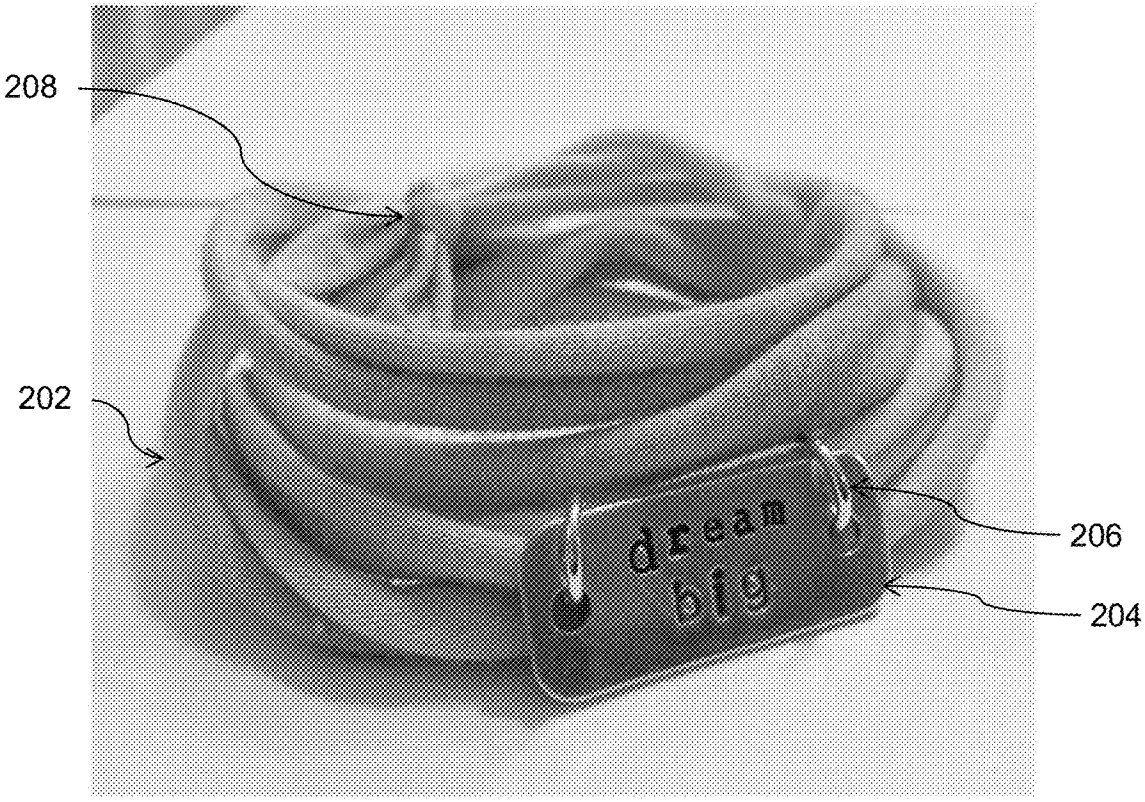
FIG. 2 illustrates an example of a fabric wrap jewelry item according to one or more embodiments of the present disclosure.

For example, the embodiment shown in FIG. 2 is an example of a bracelet that has been worn in an event where the bracelet was exposed to dye during the event (e.g., a running race where dye is thrown at or the runner runs through dye). FIG. 2 illustrates an example of a fabric wrap jewelry item according to one or more embodiments of the present disclosure. In this embodiment, the item is comprised of an elongate strip of material 202 having a length dimension and a width dimension that is shorter than the length dimension. The strip also has two ends that, in this example, are connected together by a knot 208. The item also includes a pendant 204 and two jumprings 206.

In this example, the item (fabric 202 and pendant 204 attached with jumprings 206) was worn the original color of the fabric was a white and the dye that was added was powdered dye that was pink, yellow, and orange in color. The resulting look is an item having a mix of those colors.

Although, in the embodiment shown in FIG. 2, the pendant has not been dyed, in some embodiments, one or more materials can be used to create a portion of or all of the fabric, the pendant, and/or the jumprings, that can change color based on an interaction with one or more chemicals, temperature, water, pressure, and/or light. For example, portions of the pendant could be coated in thermochromic or photochromic ink that will change color based on interaction with light, heat, and/or cold.

These embodiments could be used is a wide variety of contexts. For example, upon completing an event, the wearer could pass under an ultra-violet emitter, water misting device, or other catalyst, that would interact with the ink on the pendant or agent in the fabric to change the color or spell out "finisher" or other text on the pendant or fabric. It should be noted that other color changing technologies are known and could be used with embodiments of the present disclosure.

Traditionally, use of jewelry in running and other athletic events is frowned upon or forbidden due to their bulkiness or potential for injury due to them tangling on something during the event. However, the embodiments of the present disclosure could be worn during such events because they fit closely to the wearer, are light weight, and are stretchy, allowing them to have a reduced risk of catching on something during the activity.

Additionally, due to their dye retention properties, a fabric wrap jewelry item (e.g., a light colored one) could be worn at a color run or other type of color dye or other marking material type event. Color dye, for example in powder form (e.g., at a race where the powder is thrown) or in a liquid form (e.g., at an event where the dye is applied, such as by the wrap wearer), would then be applied during the event and then the color could be set in the fabric, such that the jewelry item becomes a memento of the event for the wearer as a reminder of the colored dye experience that the event provided.

Additionally, in some embodiments, the dye retention properties of the fabrics utilized in such embodiments of the present disclosure can allow for the fabric to be dyed by an owner of the jewelry item, for example, as an activity at an event (e.g., tie dying the jewelry item at a birthday party, for instance) or for their own personal preference (e.g., to match an outfit). In some such embodiments, they pendant could include a symbol of the event (e.g., the birthstone of the person having the birthday, a saying from the event, or other such items) and as such, the fabric wrap jewelry item becomes a memento of the event for all attendees.

Figure 3:
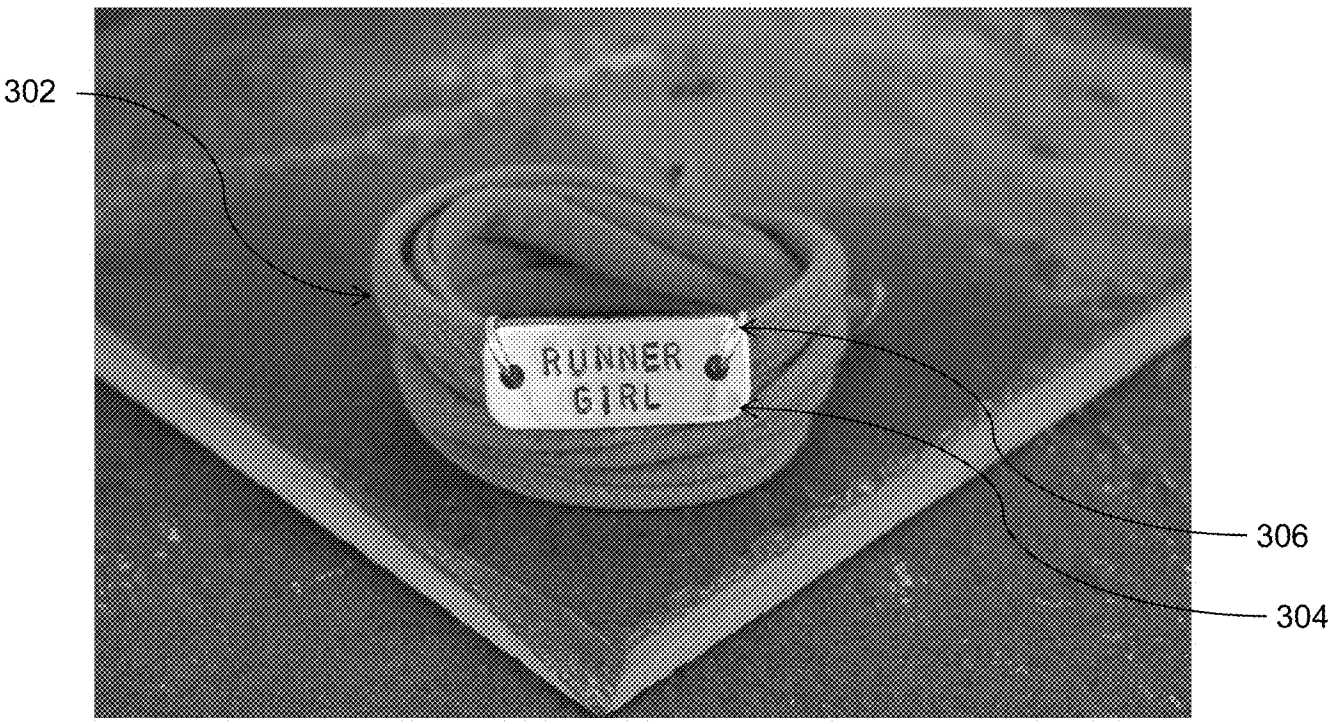
FIG. 3 illustrates another example of a fabric wrap jewelry item according to one or more embodiments of the present disclosure.

FIG. 3 shows an example of a fabric wrap jewelry item embodiment having multiple (e.g., two) jumprings utilized to connect a pendant to the fabric material designed according to an embodiment of the present disclosure. As illustrated in FIG. 2, the fabric material is an elongate strip of material 302 having a length dimension and a width dimension that is shorter than the length dimension.

Jumprings 306 are used to attach a pendant 304 (i.e., a decorative element, such as a plate or a charm) to the jewelry item, in some embodiments. In the embodiment shown in FIG. 2, the jumprings are formed by a piece of wire material bent into a ring shape and thereby forming an aperture within the ring shaped wire.

In some embodiments, at least one jumpring can be used to affix the pendant to the elongate strip of fabric by positioning the strip of fabric through an aperture formed by the jumpring such that the fabric material passes through the aperture of at least of the jumprings to allow the fabric to move with respect to the pendant allowing the pendant to be repositioned to a desired location along the length of the strip of fabric. In such embodiments, this allows the wearer to reposition the pendant to a desired location along the length of the fabric strip. The stretchy functionality of the fabric can act to hold the pendant in the position where the wearer placed the pendant, thereby improving appearance, safety, and/or comfort over prior jewelry item designs.

The choice of materials for the pendant is also provide benefits with respect to prior jewelry item designs. By choosing to utilize a material such as aluminum or fine silver (e.g., Argentium silver), for at least a portion of the pendant and/or the jumprings, the design gains advantages including, but not limited to, being light weight, capable of being customized with symbols or text via stamping thereon, hypo-allergenic, and extremely tarnish/rust-resistant (as used herein, these qualities would be considered as non-corrosive).

It should be noted that the use of a fabric wrap for the jewelry item material provides an aesthetically pleasing looking jewelry item that is also light weight and conforms to the wrist of the wearer. As such, the wearer can, in many instances, feel as if they are not wearing any jewelry as embodiments of the fabric wrap jewelry item can be very light and sized to not swing around the wearer's wrist.

Figure 4A:
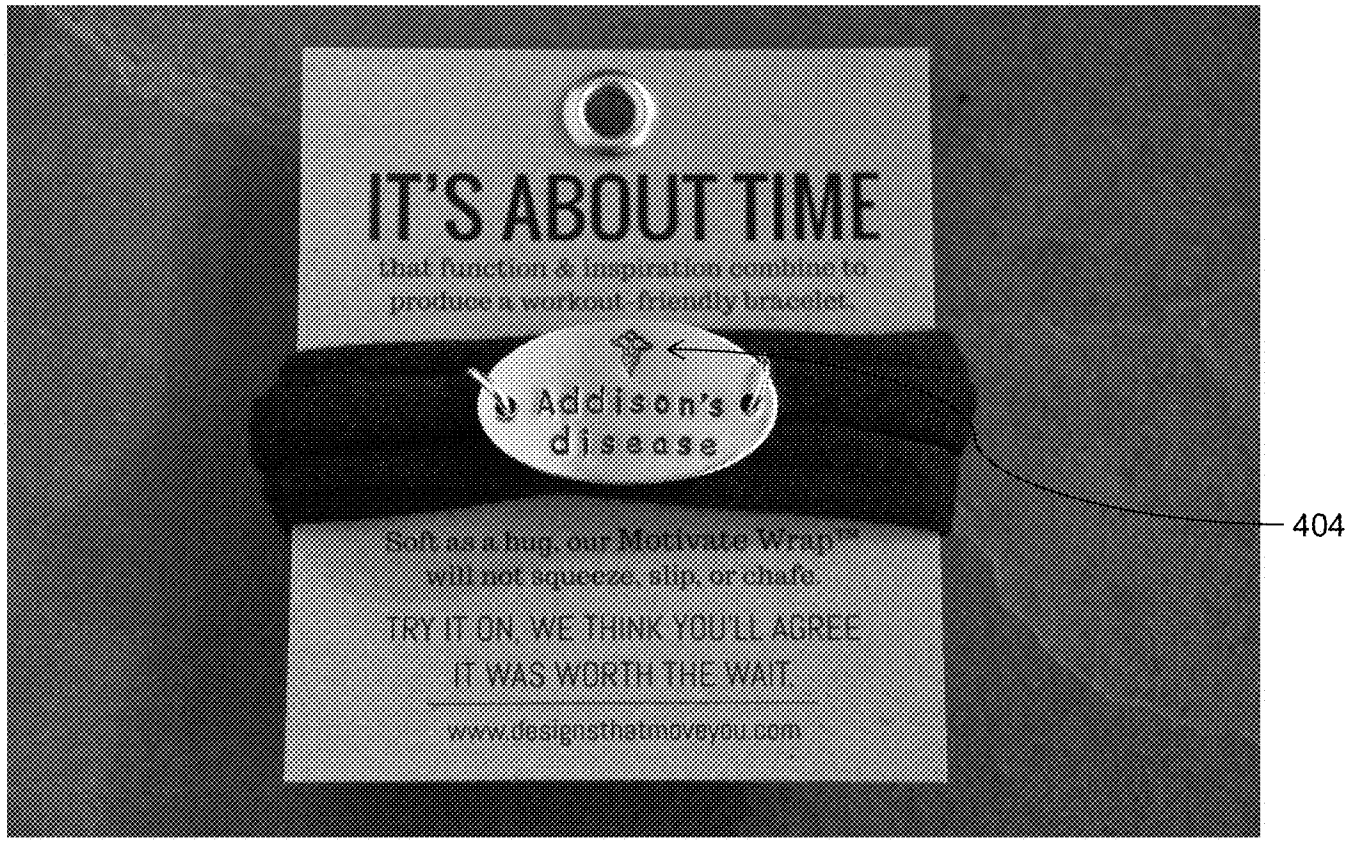
FIGS. 4A and 4B illustrate other examples of a fabric wrap medical alert bracelet or anklet according to one or more embodiments of the present disclosure.
Figure 4B:
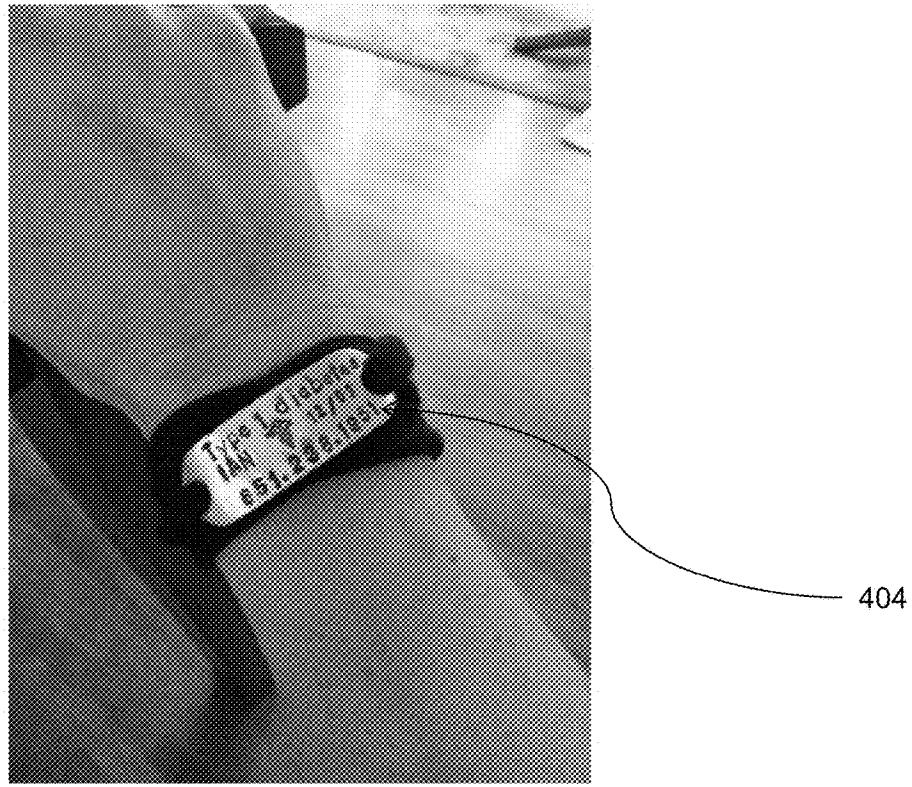

Further, when used with a pendant made from a light weight material, the wearer can have a similar experience as the pendant provides slightly more weight, but not a sufficient amount such that the wearer would notice its weight. As mentioned previously, this is especially beneficial for continual-use wearers, such as individuals with severe medical conditions. This can also be particularly helpful for children and the elderly who can be bothered by wearing other types of jewelry and can increase their compliance with wearing, for example, a necessary medical alert bracelet. FIGS. 4A and 4B illustrate other examples of a fabric wrap medical alert bracelet or anklet according to one or more embodiments of the present disclosure. As discussed herein, embodiments having medical alert information, such as the examples shown on pendants 404 in FIGS. 4A and 4B, can be very beneficial to the wearers.

In some embodiments, the wearer can customize the information printed on the pendant which may be helpful in providing critical information to a reader of the pendant that is trying to assist the wearer. This information can be added by the wearer (e.g., via stamping) or by the manufacturer of the jewelry item based on information provided by the wearer.

By utilizing a material that can be stamped, it is possible to customize the pendant with a vast array of design choices. For example, the pendant can then include names of family members, race finish times, race dates, motivational or other sayings, and/or symbols among other items. This material can be stamped at the time of manufacture, or could be customized by the owner allowing their own customization or allowing for the making of jewelry items to be done as an activity, such as at a party or other such event.

Figure 5:
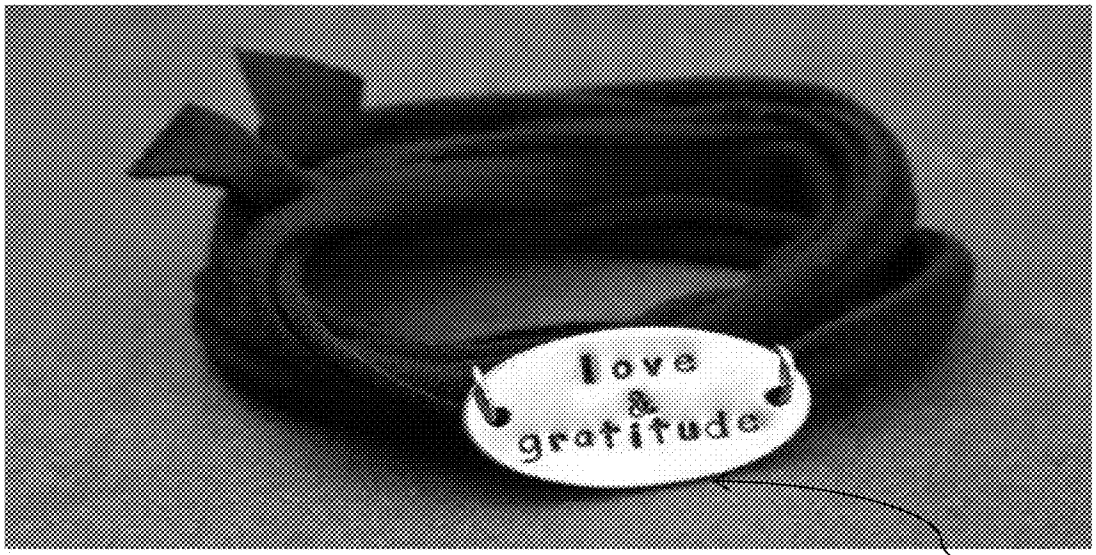
FIG. 5 illustrates another example of a fabric wrap jewelry item according to one or more embodiments of the present disclosure.

FIG. 5 illustrates another example of a fabric wrap jewelry item according to one or more embodiments of the present disclosure. In this embodiment, the pendant 504 includes a message to or from a loved one that the wearer is using for inspiration.

Further, the embodiments of the present disclosure are designed as to allow the fabric wrap portion of the jewelry item to be positioned between the pendant (and/or the at least one jumpring) and the wearer's skin, thereby allowing many wearers to use the embodiments of the present disclosure that may not otherwise be able to wear jewelry. In embodiments utilizing a material with hypo-allergenic qualities this allows wearers with highly sensitive skin to wear such embodiments with confidence that they will not have an allergic reaction to the material.

In such embodiments having tarnish resistant qualities, the tarnish resistant qualities, for example, allow the jewelry items to be relatively low maintenance while maintaining a high quality look that wearer's desire. Due to the active events that such jewelry items may be worn and their exposure to sweat, road salt, chemicals, dyes, and other substances, embodiments fabricated from a material that is corrosion resistant to at least one of: salt, water, a corrosive chemical, and a dye may have benefits in such environments.

Additionally, such qualities allow for the fabric wrap jewelry item to be washed either by hand or in a mechanical washing machine without damage to the look of the jewelry item which make maintenance of the jewelry item easy and generally worry-free for the wearer. For example, in some embodiments, the pendant (e.g., made from aluminum or fine silver), at least one jumpring (e.g., made from aluminum or fine silver), and strip of fabric (95% Rayon and 5% Spandex) are constructed of materials that can be washed in a mechanical washing machine without damage (i.e., to ruin the look and/or the functionality of the pendant, jumpring, or fabric) to any of the pendant, at least one jumpring, and strip of fabric.

These advantages are important as they support the qualities and goals (such as comfort, durability, etc.) as well as add value to the embodiments of the current disclosure in other ways not specifically mentioned above.

Figure 6A:
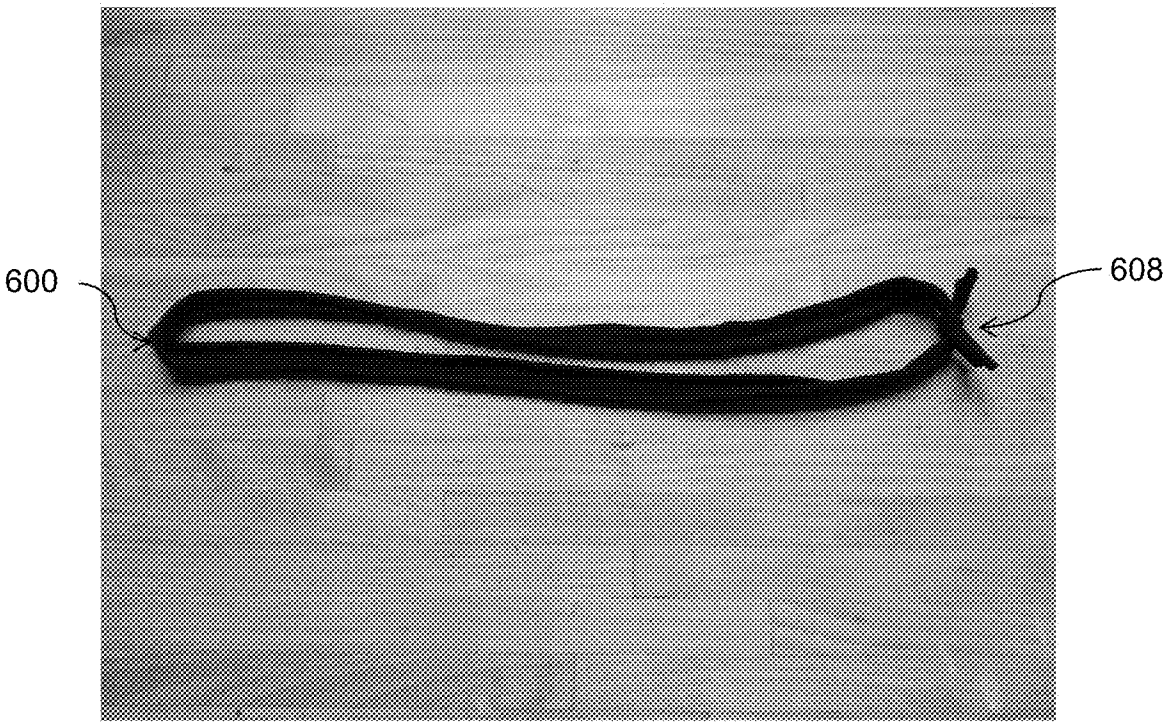
FIGS. 6A-6D illustrate how a wearer can wrap an embodiment of a fabric wrap jewelry item onto their wrist.
Figure 6B:
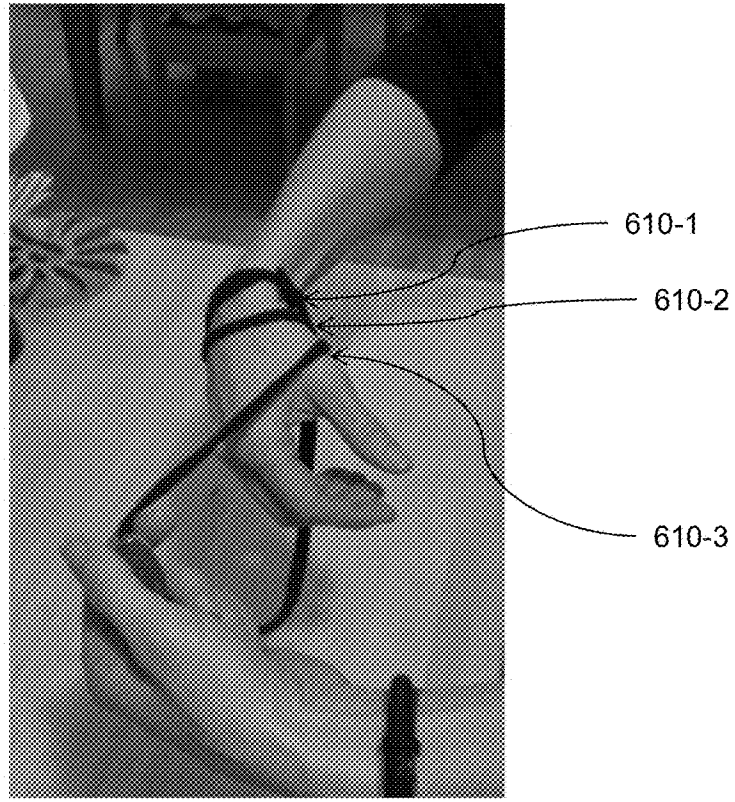
Figure 6C:
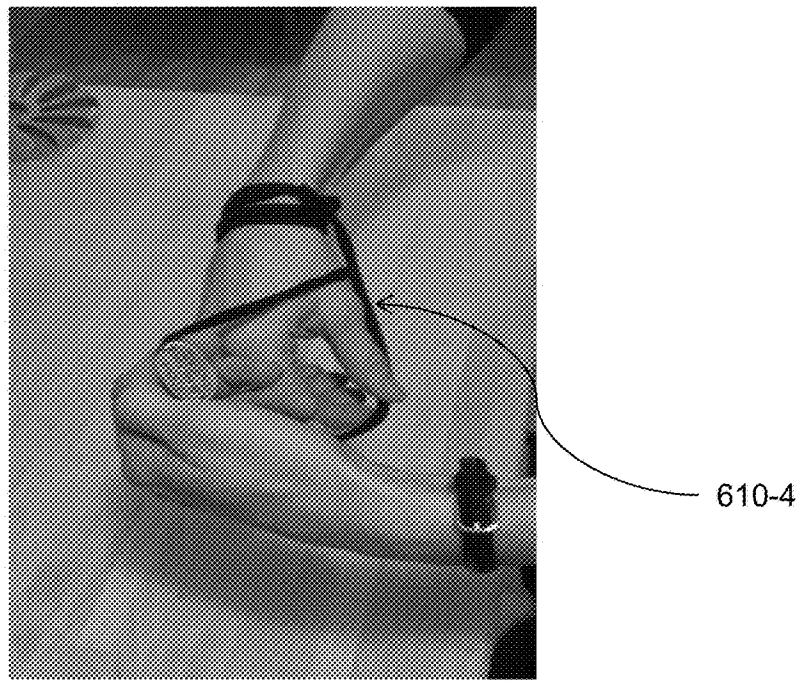

FIGS. 6A-6D illustrate how a wearer can wrap an embodiment of a fabric wrap jewelry item onto their wrist. FIG. 6A shows an example of a strip of fabric 604 having a knot tied at the ends 608 to form a loop of material to be wrapped around an appendage of a wearer. FIG. 6B illustrates the initial wrapping of a fabric wrap jewelry item where the wearer has wrapped the item around her wrist three times (e.g., wraps 610-1, 610-2, and 610-3). FIG. 6C shows a fourth wrap 610-4 being made.

Figure 6D:
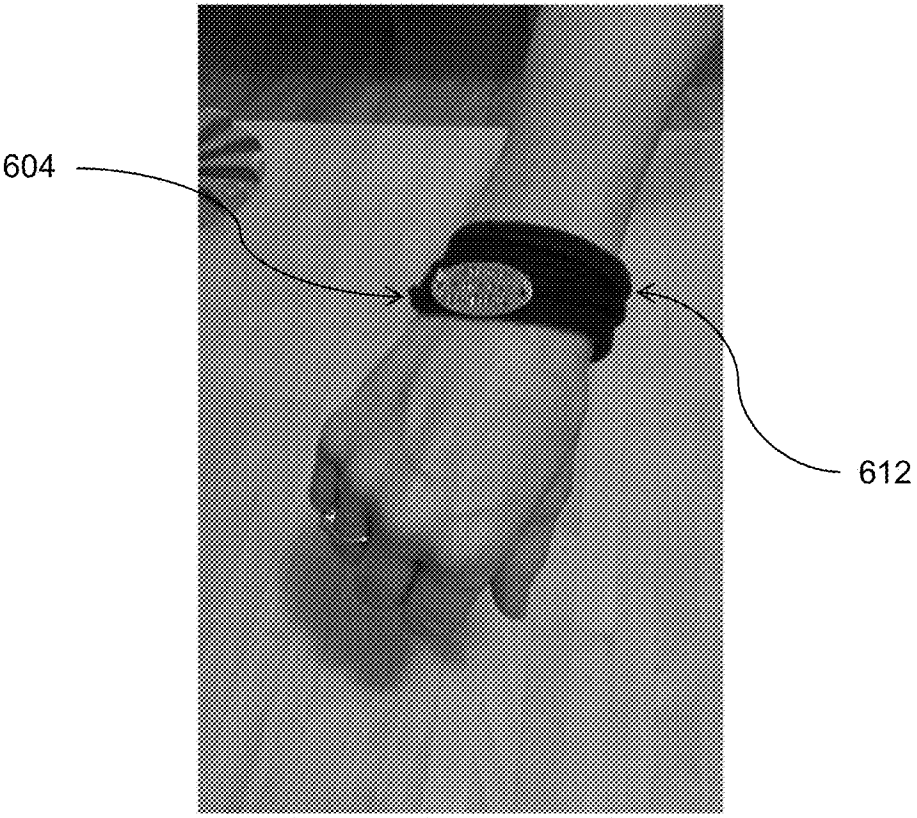

FIG. 6D shows the fabric wrap jewelry item fully wrapped around the wearer's wrist where the strip of fabric 612 is wrapped to a tightness that allows the item to be somewhat fixed in its orientation on the wearer (i.e., the pendant will not rotate around the wearer's wrist and the fabric will not rotate around or up or down the arm of the wearer, but may move slightly as the wearer moves their wrist/arm). Although the wearer may wear the item in a looser or tighter manner, using the orientation illustrated in FIG. 6D may be ideal in many instances. Also, as illustrated, in this orientation, the fabric is positioned between the pendant/jumprings and the wearer and such an arrangement provides benefits as discuss further herein.

Figure 7A:
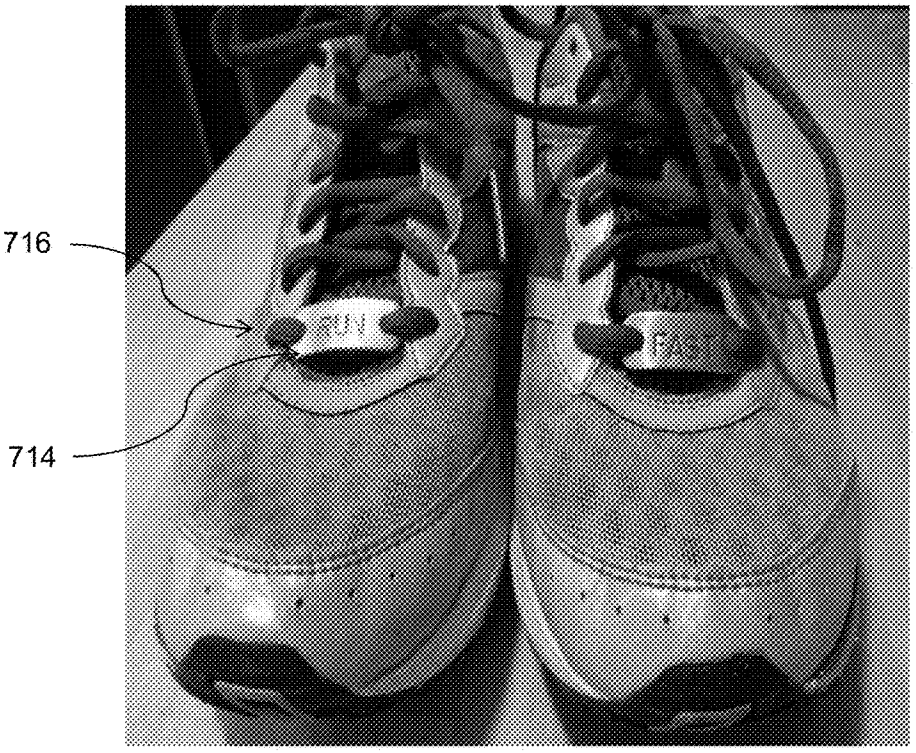
FIGS. 7A and 7B illustrate examples of a customizable tag attached to shoes of a user according to one or more embodiments of the present disclosure.
Figure 7B:
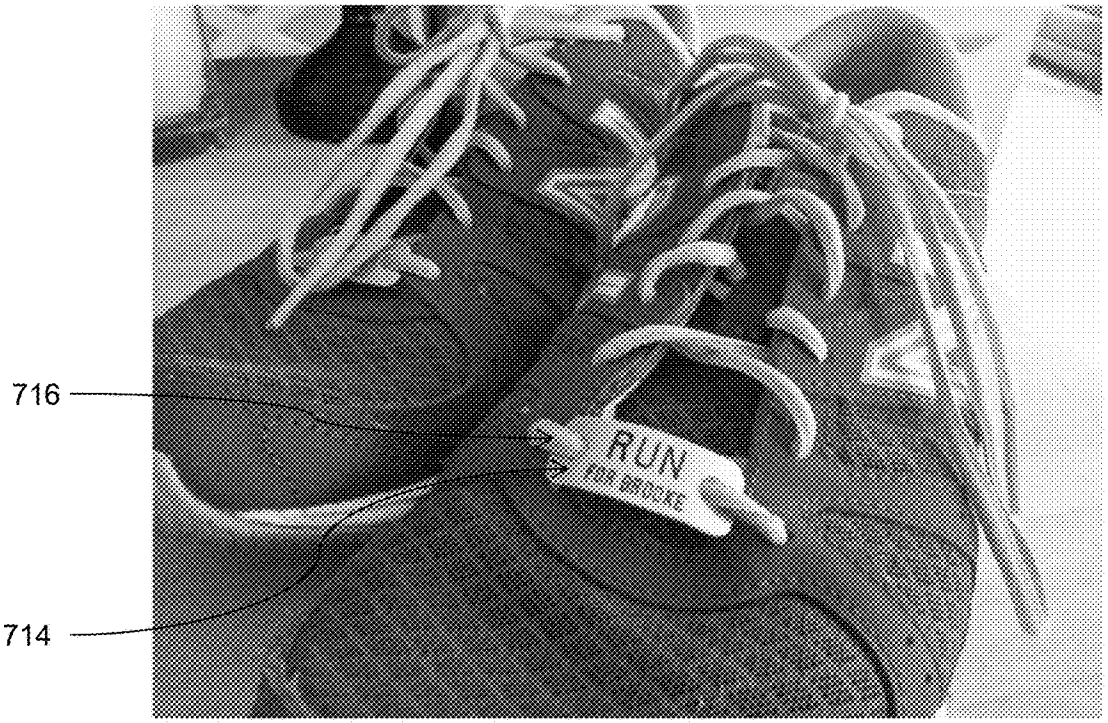

Additional to the fabric wrap jewelry item, the present disclosure also includes embodiment for a decorative customizable tag or tags that can be threaded onto a lace or strap and worn as a jewelry item, such as on footwear or affixation to hats, such as to the strap on an adjustable baseball cap. FIGS. 7A and 7B illustrate examples of a customizable tag attached to shoes of a user according to one or more embodiments of the present disclosure.

These are comprised of a metal tag that is to be stamped with a custom saying or phrase that is meaningful to the wearer and laced (the lace/strap 716 is threaded through one or more apertures on the tag 714) into footwear or hat as displayed in FIGS. 7A and 7B. As discussed above, aluminum, high quality silver, or other such materials tend to be a good choice of material for this use due to its easily-stampable hardness, its light weight, and its non-tarnishing properties, among other benefits.

Such tags allow for the manufacturer to easily change the sayings that they are offering for sale without the need to change tooling or design new charms. Additionally, some embodiments could be designed to allow the wearer to place their own customized expression (letters, numbers, and/or symbols) on the tags. In some embodiments, a set may include multiple tags and the tags together may form a longer expression when viewed together. For example, as shown on the tags 714 in FIG. 7A, the expression may be two words, with one word placed on each shoe.

In some embodiments, a group of runners may place a longer saying on their shoes as a group (e.g., a birthday wish for one of their friends, or a memorial to someone lost to cancer for a group of cancer charity runners as illustrated on the tag 714 in FIG. 7B). For example, the message may span across the tags of several wearers, such that when the wearers come together, the message can be read. The tags may include the placement of the wearer in a prestigious race that they would like to remember or a race organization may give out tags with the wearer's number stamped on it as a memento.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the use of the terms "a", "an", "one or more", "a number of", or "at least one" are all to be interpreted as meaning one or more of an item is present. Additionally, it is to be understood that the above description has been made in an illustrative fashion, and not a restrictive one. Combination of the above embodiments, and other embodiments not specifically described herein will be apparent to those of skill in the art upon reviewing the above description. As used herein, the term "and/or" includes any and all combinations of one or more of the associated listed items.

What is claimed:

1. A fabric wrap jewelry item, comprising:

an elongate strip of fabric having elastic qualities and having:

a width defined by two edges, wherein each of the two edges curl towards a longitudinal axis of the elongate strip of fabric such that neither of the two edges are exposed; and two ends connected together to form a loop of fabric material, wherein the elastic qualities allow the loop of fabric material to be stretched to a stretched length that is longer than an un-stretched length and then return to the un-stretched length, wherein the un-stretched length of the loop of fabric material is sized to be wrapped at least twice around an appendage of a wearer; and a pendant affixed to the elongate strip of fabric, wherein, when the length of the loop of fabric material is wrapped at least twice around the appendage of a wearer, the pendant is separated from the appendage of the wearer by the wrappings of the loop of fabric material around an appendage of the wearer.

2. The fabric wrap jewelry item of claim 1, wherein the material that has elastic qualities is comprised of 95% Rayon and 5% Spandex.

3. The fabric wrap jewelry item of claim 1, wherein the elongate strip of fabric is made from a material that can be cut to a shorter length.

4. The fabric wrap jewelry item of claim 1, wherein the elongate strip of fabric is sized such that the ends can be tied together to form the loop of fabric material.

5. The fabric wrap jewelry item of claim 1, wherein the elongate strip of fabric is sized such that the ends can be connected together by adhesive to form the loop of fabric material.

6. The fabric wrap jewelry item of claim 1, wherein the elongate strip of fabric is sized such that the ends can be mechanically connected together to form the loop of fabric material.

7. The fabric wrap jewelry item of claim 1, wherein the fabric wrapped jewelry item includes at least one jumpring that affixes the pendant to the elongate strip of fabric.

8. A fabric wrap jewelry item, comprising:

an elongate strip of fabric having elastic qualities and having:

a width defined by two edges, wherein each of the two edges curls towards a longitudinal axis of the elongate strip of fabric such that neither of the two edges are exposed; and; and two ends connected together to form a loop of fabric material, wherein the elastic qualities allow the loop of fabric material to be stretched to a stretched length that is longer than an un-stretched length and then return to the un-stretched length, wherein the un-stretched length of the loop of fabric material is sized to be wrapped at least twice around an appendage of a wearer; and a pendant affixed to the elongate strip of fabric, wherein, when the length of the loop of fabric material is wrapped at least twice around the appendage of a wearer, the pendant is separated from the appendage of the wearer by the at least two wrappings of the loop of fabric material.

9. The fabric wrap jewelry item of claim 8, wherein the fabric wrapped jewelry item includes at least one jumpring that affixes the pendant to the elongate strip of fabric by positioning the strip of fabric through the aperture formed by the jumpring such that the fabric material passes through the aperture of at least of the jumprings to allow the fabric to move with respect to the pendant allowing the pendant to be repositioned to a desired location along the length of the strip of fabric.

10. The fabric wrap jewelry item of claim 8, wherein the pendant is fabricated from a material that is corrosion resistant to at least one of: salt, water, a corrosive chemical, and a dye.

11. The fabric wrap jewelry item of claim 8, wherein the pendant is fabricated from a material that is hypo-allergenic.

12. The fabric wrap jewelry item of claim 8, wherein the pendant is fabricated from a material that consists, at least in part, of one of: aluminum or silver.

13. The fabric wrap jewelry item of claim 8, wherein the strip of fabric is fabricated from a material that allows dye to be applied at an event in which the wearer of the jewelry item participates and the dye changes the color of at least a portion of the strip.

14. A fabric wrap jewelry item, comprising:

an elongate strip of fabric having elastic qualities and having:

a width defined by two edges, wherein each of the two edges curls towards a longitudinal axis of the elongate strip of fabric such that neither of the two edges are exposed; and two ends connected together to form a loop of fabric material, wherein the elastic qualities allow the loop of fabric material to be stretched to a stretched length that is longer than an un-stretched length and then return to the un-stretched length, wherein the un-stretched length of the loop of fabric material is sized to be wrapped at least twice around an appendage of a wearer; and a pendant affixed to the elongate strip of fabric with at least one jumpring wherein the elongate strip of fabric passes through an aperture formed by the jumpring, wherein the pendant is made from a metallic material having a hardness that allows for the pendant to be customized by indentation of one or more stamps, and wherein, when the length of the loop of fabric material is wrapped at least twice around the appendage of a wearer, the pendant is separated from the appendage of the wearer by the at least two wrappings of the loop of fabric material.

15. The fabric wrap jewelry item of claim 14, wherein the pendant is made from a metallic material having a hardness that allows for the pendant to be customized by indentation of one or more stamps that are hammered by a user against the pendant to make the indentation.

16. The fabric wrap jewelry item of claim 14, wherein the elongate strip of fabric is made from a material that does not fray at the edges after being cut into strips.

17. The fabric wrap jewelry item of claim 14, wherein the pendant is fabricated from a material that consists, at least in part, of Argentium silver.

18. The fabric wrap jewelry item of claim 14, wherein the pendant, at least one jumpring, and strip of fabric are constructed of materials that can be washed in a mechanical washing machine without damage to any of the pendant, at least one jumpring, and strip of fabric.

19. The fabric wrap jewelry item of claim 14, wherein the strip of fabric is sized to allow a portion of the strip of fabric to be positioned between the wearer and at least one of: the at least one jumpring and the pendant.

* * * * *